US005923623A

United States Patent [19]

Lee

[11] Patent Number: 5,923,623

[45] **Date of Patent: *Jul. 13, 1999**

[54] MEANS FOR DETACHABLY ATTACHING ORNAMENTAL CONTAINER TO WRIST WATCH

[76] Inventor: Vincent Kuo Wei Lee, No. 44, Lane 458, Sheh Chung Street, Taipei, Taiwan

[ * ] Notice: This patent is subject to a terminal disclaimer.

[21] Appl. No.: 09/010,991

[22] Filed: Jan. 22, 1998

[51] Int. Cl.[6] ..... G04B 47/06

[52] U.S. Cl. ..... 368/278; 368/283; 368/286

[58] Field of Search ..... 368/278, 281, 368/282, 223–239

[56] References Cited

U.S. PATENT DOCUMENTS 3,712,049 1/1973 Luxemberg ..... 368/278

5,018,118 5/1991 Ross ..... 368/278

5,652,736 7/1997 Lee ..... 368/272

*Primary Examiner*—Bernard Roskoski

*Attorney, Agent, or Firm*—Bacon & Thomas

[57] ABSTRACT

An arrangement for detachably attaching an ornamental container to a wrist watch includes a supporting frame for the ornamental container to detachably connect thereto, and two thin and soft strips with transversely spaced teeth provided on an inner surface thereof. The strips are threaded through slots formed on corner lugs of the supporting frame in predetermined steps, so that the strips extend across below the wrist watch to easily but firmly and detachably tie the supporting frame to a top of the wrist watch.

3 Claims, 3 Drawing Sheets

MEANS FOR DETACHABLY ATTACHING ORNAMENTAL CONTAINER TO WRIST WATCH

BACKGROUND OF THE INVENTION

In U.S. Pat. No. 5,652,736 titled "Ornamental container Detachably Attached to Wrist Watch" granted to the applicant (also the inventor) on Jul. 29, 1997, a supporting frame and two U-shaped fixing members are disclosed and they cooperate with one another to sandwich a wrist watch case between them, so that an ornamental container can be pivotally and detachably connected to the supporting frame over the watch-case. In this patent, the supporting frame is provided on its outer periphery at four corners with four lugs each having a central through hole, so that four screws can be extended through the four holes on the supporting frame and screwed into two ends of each of the two U-shaped fixing members to fasten the supporting frame and the fixing members together. With this structure, at least four tiny screws and two U-shaped fixing members are needed. Moreover, two ends of each U-shaped fixing member must be internally threaded. A small screwdriver is also needed to tighten the tiny screws to complete the assembling. The complicated structure and assembling results in high manufacturing cost which has, of course, adverse influence on the wide acceptance of the product by the consumers. Therefore the applicant has now improved the above-mentioned patented invention to simplify the accessories and assembling thereof.

SUMMARY OF THE INVENTION

It is a primary object of the present invention to provide means for detachably attaching an ornamental container to a wrist watch, in which a supporting frame having the ornamental container connected thereto is provided at each of its four corner lugs with two parallel slots extending in a direction the same as a watchband of the wrist watch, so that two thin and soft strips may be threaded through these slots to conveniently tie the supporting frame to a top of the casing of the wrist watch. Since the strips are provided on an inner surface with transversely spaced teeth, they can be firmly retained in place in the slots without easily sliding relative to the slots by engaging the teeth with edges of the slots. As a result, the supporting frame of the ornamental container can be more easily detachably attached to the wrist watch.

DETAILED DESCRIPTION OF THE PREFERRED EMBODIMENT

Figure 1:
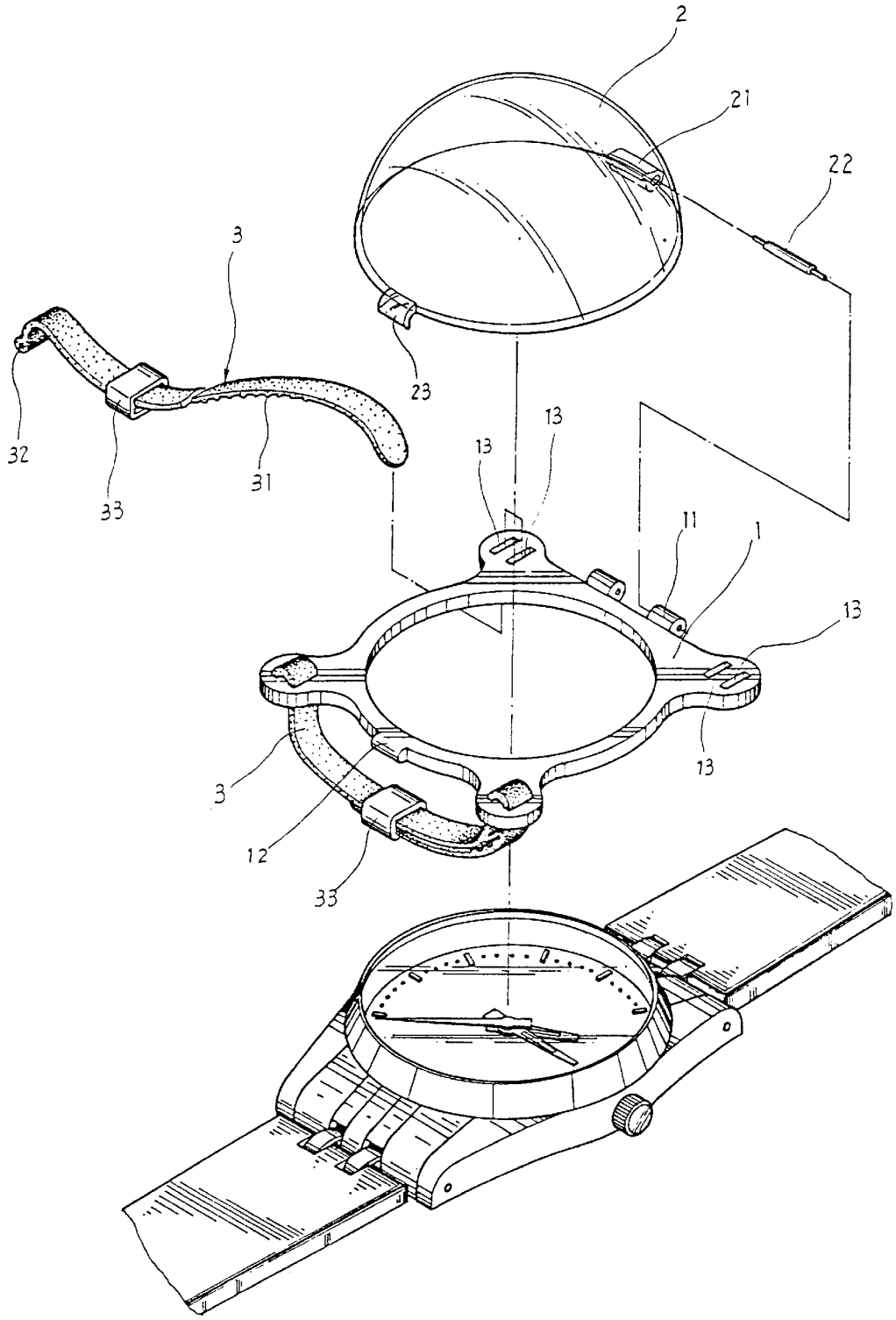
FIG. 1 is an exploded perspective of the present invention before being attached to a wrist watch.
Figure 2:
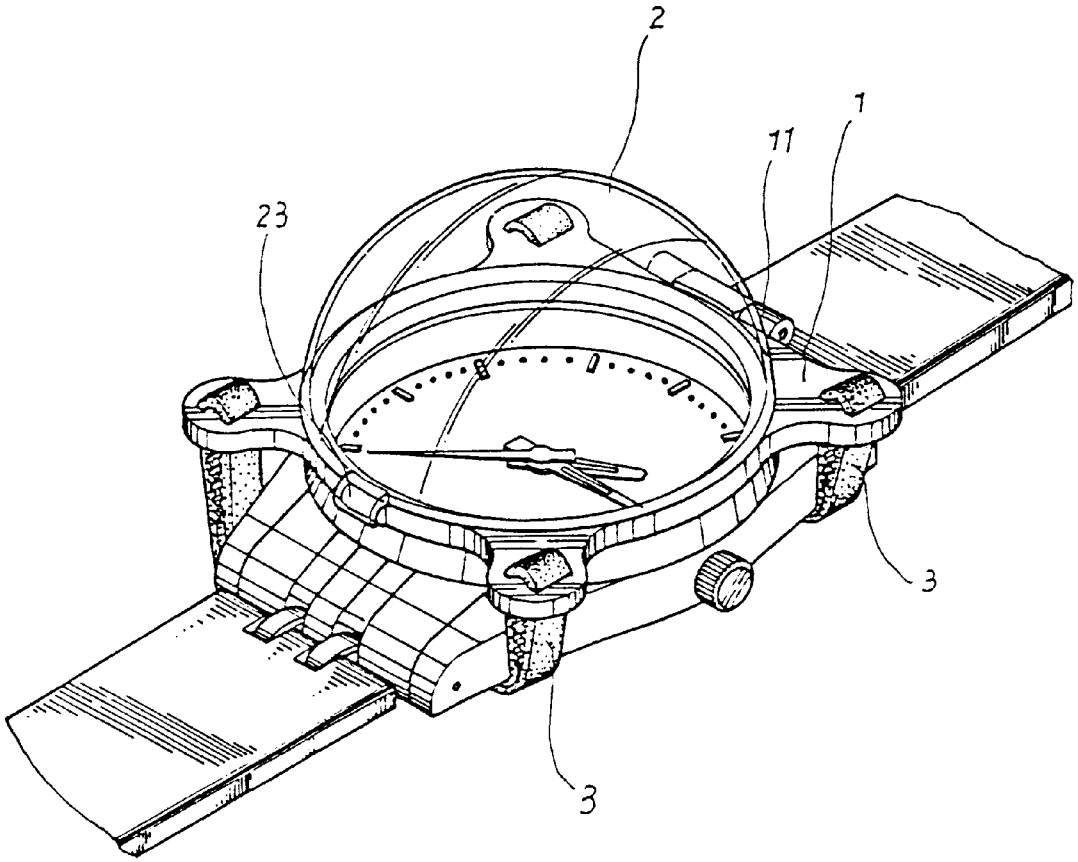
FIG. 2 is an assembled perspective showing an ornamental container being tied over a wrist watch with the present invention.
Figure 3:
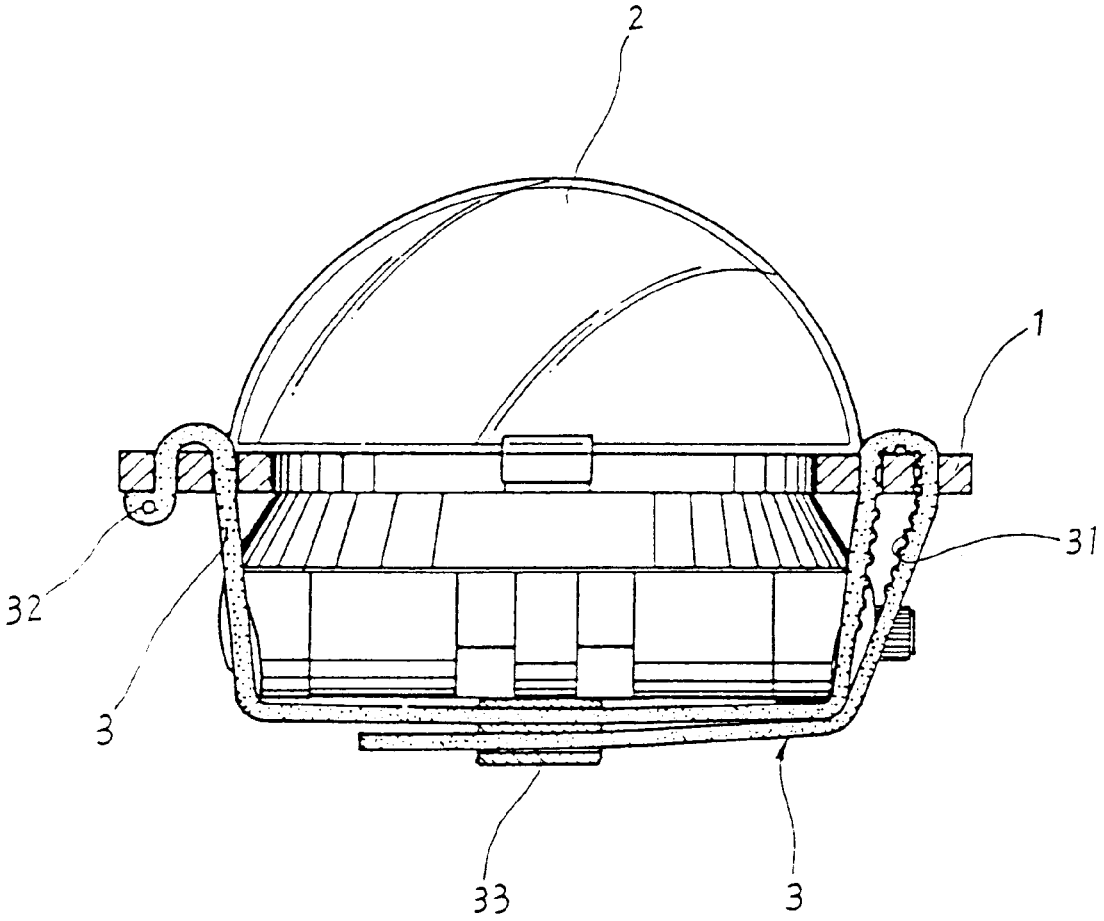
FIG. 3 is an end view of the wrist watch of FIG. 2 with the ornamental container and the present invention attached thereto.

Please refer to FIGS. 1, 2, and 3 at the same time. The present invention relates to an arrangement for detachably attaching an ornamental container 2 to a wrist watch and mainly includes a supporting frame 1 and two strips 3.

The supporting frame 1 and the ornamental container 2 have structures substantially the same as that disclosed in U.S. Pat. No. 5,652,736 titled "Ornamental Container Detachably Attached to Wrist Watch" and granted to the applicant on Jul. 29, 1997. In the present invention, the supporting frame 1 also has a pair of retaining members 11 and a projecting key 12 provided on an outer periphery thereof, and the ornamental container 2 also includes a sleeve 21, an elastic pin 22, and a catcher 23 for pivotally and detachably connecting the container to the supporting frame 1. However, the supporting frame 1 according to the present invention is provided at each of its four corner lugs with two parallel slots 13 instead of the through hole disclosed in U.S. Pat. No. 5,652,736. The slots 13 extend in the same direction as a watchband of the wrist watch.

The two strips 3 are identical to each other and therefore only one of them will be described herein. As shown, the strip 3 is a thin and soft long member preferably made of plastic or rubber material. A plurality of transversely spaced teeth 31 are provided on an inner surface of the strip 3 within a predetermined section. The teeth 31 are so sized that they are suitable for engaging with edges of the slots 13. A first end 32 of the strip 3 forms a small round pipe having an expanded diameter larger than a width of the slots 13, preventing the end 32 of the strip 3 from passing through the slots 13. A loop 33 is loosely provided around the strip 3 to allow another free end of the strip 3 to extend through.

To detachably attach the ornamental container 2 to the wrist watch via the present invention, first thread the free end of one strip 3 through a first outer slot 13 of one slot pair 13 located at one of the four corner lugs of the supporting frame 1 from a bottom side of the supporting frame 1. Pull the strip 3 forward until the expanded end 32 of the strip 3 abuts against and is stopped by the outer slot 13. Thread the free end of the strip 3 downward through a first inner slot 13 in the same slot pair. Allow the strip 3 to extend across below the wrist watch before threading the free end of the strip 3 upward through a second inner slot 13 of another slot pair in the corner lug at opposite side of the wrist watch. Further thread the free end of the strip 3 downward through a second outer slot 13 adjacent to the second inner slot 13. Adjust and tighten the strip 3 so that teeth 31 provided on inner surface of the strip 3 tightly press against and engage with edges of the slots 13, preventing the strip 3 from easily sliding relative to the slots 13. Repeat the same procedures to tie the supporting frame 1 to the wrist watch with another strip 3. Finally, connect the ornamental container 2 to a top of the supporting frame 1 by threading the pin 22 through the retaining members 11 on the supporting frame 1 and the sleeve 21 on the ornamental container 2 and by engaging the catcher 23 on the ornamental container 2 with the projected key 12 on the supporting frame 1. The free ends of the strips 3 can be extended through the loops 33 around the strips 3 and be fixed thereto, completing the whole procedures of detachably attaching the ornamental container 2 to the wrist watch with the present invention.

What is claimed is:

1. An arrangement for detachably attaching an ornamental container to a casing of a wrist watch, comprising a supporting frame and two tying strips; said supporting frame being provided on its outer periphery at predetermined positions with a pair of retaining members and a projecting key respectively arranged to detachably engage a sleeve and a catcher on said ornamental container, said supporting frame also having four corner lugs formed on its outer periphery, each of said four corner lugs including two parallel slots extending in a same direction as a watchband of said wrist watch, wherein said two strips are arranged to be separately threaded through said slots included in two of said corner lugs at opposite sides of said wrist watch to thereby firmly but detachably tie said supporting frame to a top of said casing of said wristwatch.

2. An arrangement for detachably attaching an ornamental container to a wrist watch as claimed in claim 1, wherein each said strip is a thin member made of soft material and has a first end forming a small round pipe with an expanded diameter larger than a width of said slots.

3. An arrangement for detachably attaching an ornamental container to a wrist watch as claimed in claim 1, wherein each said strip is provided on an inner surface within a predetermined section with a plurality of transversely spaced teeth suitable for engaging edges of said slots, wherein said strips can be threaded through and located in said slots without easily sliding relative to said slots, allowing said supporting frame to be firmly tied onto said casing of said wrist watch.

* * * * *